US010927602B2

(12) United States Patent
Wentworth et al.

(10) Patent No.: US 10,927,602 B2
(45) Date of Patent: Feb. 23, 2021

(54) REVERSIBLE PNEUMATIC PIPE RAMMING TOOL

(71) Applicant: Earth Tool Company LLC, Lake Mills, WI (US)

(72) Inventors: Steven W. Wentworth, Scottsdale, AZ (US); Robert F. Crane, Nekoosa, WI (US); Mark D. Randa, Oconomowoc, WI (US); Kelvin C Aus, Watertown, WI (US)

(73) Assignee: The Charles Machine Works, Inc., Perry, OK (US)

( * ) Notice: Subject to any disclaimer, the term of this patent is extended or adjusted under 35 U.S.C. 154(b) by 154 days.

(21) Appl. No.: 16/178,753

(22) Filed: Nov. 2, 2018

(65) Prior Publication Data

US 2019/0136629 A1 May 9, 2019

Related U.S. Application Data

(60) Provisional application No. 62/580,967, filed on Nov. 2, 2017.

(51) Int. Cl.

| | |
|---|---|
| ***E21B 4/14*** | (2006.01) |
| ***E21B 7/20*** | (2006.01) |
| ***E21B 7/26*** | (2006.01) |
| ***E21B 7/04*** | (2006.01) |

(52) U.S. Cl.

CPC ..... *E21B 4/145* (2013.01); *E21B 7/046* (2013.01); *E21B 7/206* (2013.01); *E21B 7/26* (2013.01)

(58) Field of Classification Search

CPC .. E21B 4/14; E21B 4/145; B25D 9/14; B25D 9/16; B25D 9/18

See application file for complete search history.

(56) References Cited

U.S. PATENT DOCUMENTS

| | | | | |
|---|---|---|---|---|
| 3,701,386 | A * | 10/1972 | Feucht | E21B 21/01 173/78 |
| 3,749,186 | A * | 7/1973 | Kutuzov | E21B 21/12 175/228 |
| 4,179,983 | A * | 12/1979 | Wallace | F01B 11/02 173/208 |
| 5,505,270 | A | 4/1996 | Wentworth | |
| 5,603,383 | A | 2/1997 | Wentworth et al. | |
| 6,467,544 | B1 | 10/2002 | Millican | |
| 6,644,417 | B1 | 11/2003 | Millican | |

(Continued)

*Primary Examiner* — Gloria R Weeks

(74) *Attorney, Agent, or Firm* — Tomlinson McKinstry, P.C.

(57) ABSTRACT

A reversible pipe ramming tool used in horizontal pipe replacement operations. The tool is powered by a pneumatic hose attached to a rear end of the tool. The tool has forward and rearward fluid paths, which can either communicate with one another or stand in isolation. Fluid flow along the forward fluid path, when it is maintained in isolation from the reverse fluid path, causes the tool to move in a forward direction. Fluid flow along the forward fluid path, when it is maintained in communication with the reverse fluid path, causes the tool to move in a rearward direction. The tool is switched between forward and reverse by flowing fluid through a pilot fluid path in fluid communication with a valve. Movement of a shuttle within the valve selectively isolates the forward fluid path from the reverse fluid path.

20 Claims, 7 Drawing Sheets

(56) References Cited

U.S. PATENT DOCUMENTS

| | | | | |
|---|---|---|---|---|
| 6,953,095 | B2 | 10/2005 | Randa | |
| 6,994,175 | B2 * | 2/2006 | Egerstrom | E21B 4/14 175/296 |
| 7,073,610 | B2 * | 7/2006 | Susman | E21B 4/14 173/53 |
| 8,167,051 | B2 * | 5/2012 | Eddison | E21B 21/103 166/177.7 |
| 8,297,378 | B2 * | 10/2012 | Hall | E21B 4/14 175/107 |
| 8,893,827 | B2 * | 11/2014 | Kosovich | E21B 4/14 166/242.6 |
| 2016/0040481 | A1 * | 2/2016 | Spektor | E21B 7/26 175/19 |

* cited by examiner

REVERSIBLE PNEUMATIC PIPE RAMMING TOOL

SUMMARY

The present invention is directed to a ramming tool. The tool comprises a housing having an elongate internal chamber having opposed ends. A fixed first anvil is situated within and supported by the housing at one end of the chamber, and a fixed second anvil is situated within and supported by the housing at the second end of the chamber. A reciprocating striker is positioned within the chamber between the anvils. The tool further comprises a fluid distribution block fixedly positioned within the chamber. The block comprises a forward fluid path, and a reverse fluid path. The reverse fluid path is fluidly communicable with the forward fluid path. Fluid flow through the communicating forward and reverse fluid paths causes the striker to impact the second anvil. Fluid flow through the forward fluid path, in isolation of the reverse fluid path, causes the striker to impact the first anvil. A valve is also supported within the block that is adapted to selectively isolate the forward and reverse fluid paths.

DETAILED DESCRIPTION

Figure 1:
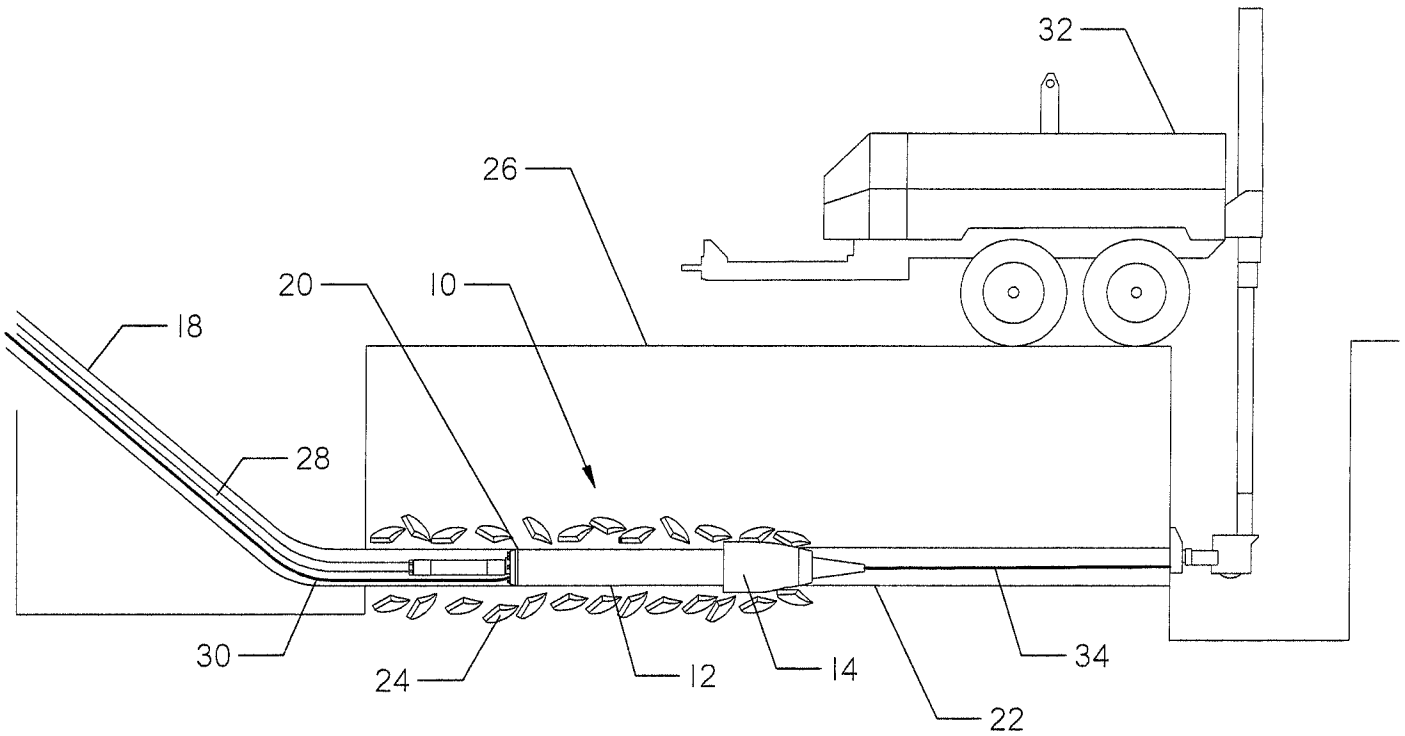
FIG. 1 is an illustration of a horizontal pipe replacement operation using a ramming tool. A conical burst head and new pipe are shown attached to the ramming tool.
Figure 2:
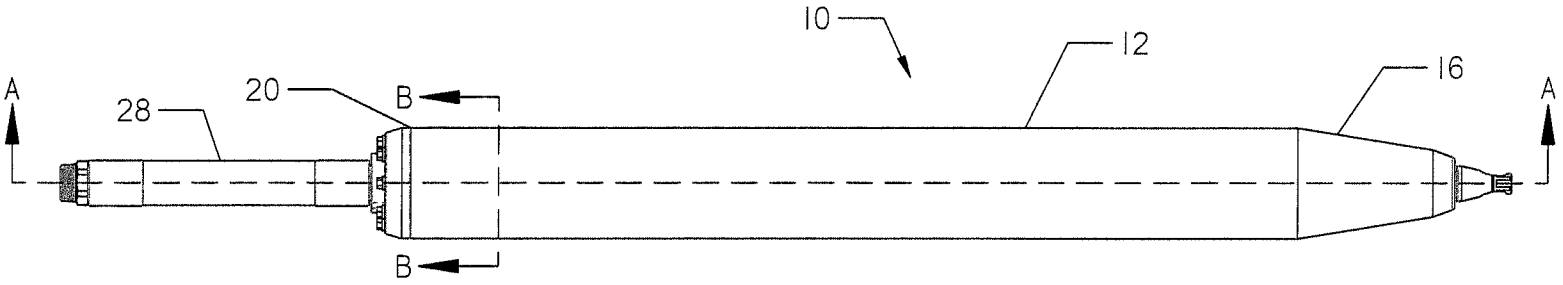
FIG. 2 is a top view of the ramming tool operating in the forward direction.
Figure 7:
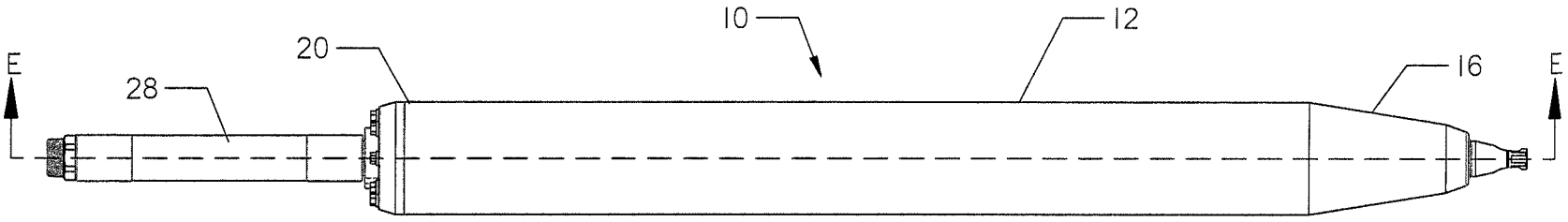
FIG. 7 is a top view of the ramming tool operating in the reverse direction.

With reference to FIGS. 1-2 and 7, a pneumatic pipe ramming tool 10 having an elongate housing 12 is shown. The tool 10 is used in underground horizontal pipe replacement operations, as shown in FIG. 1. Prior to starting replacement operations, a conical burst head 14 is secured to a tapered front end 16 of the housing 12, shown in FIG. 2, and a new pipe 18 is secured to a rear end 20 of the housing 12. The tool 10 is then positioned so that the burst head 14 is engaged with the opening of an existing underground pipe 22.

Once in position, the tool 10 is activated so as to percussively thrust the burst head 14 forward through the existing pipe 22. The burst head 14 operates to crack the existing pipe 22 and expand shards 24 into the surrounding soil as the tool 10 forces the burst head 14 forward. Simultaneously, the tool 10 pulls the new pipe 18 through the subsurface so as to replace the previously existing pipe 22.

The tool 10 is powered by a compressor (not shown) positioned at the ground surface 26 above the opening of the existing pipe 22. The compressor supplies compressed air or fluid to the tool 10 via a first and second hose 28, 30 attached to the rear end 20 of the housing 12. During operation, the hoses 28, 30 are disposed within the new pipe 18 and must stretch the entire length of the new pipe, which may be 300 to 500 feet long.

A winch 32 positioned at the ground surface 26 above the end of the existing pipe 22 is used to help pull the tool 10 forward during operation. The winch 32 pulls a cable 34 secured to the burst head 14 through the existing pipe 22.

When the ramming tool 10 reaches the end of the existing pipe 22, it is detached from the burst head 14. Once detached, the tool 10 is pulled back through the new pipe 18 to the ground surface 26 using the hoses 28, 30. The burst head 14 is pulled to the ground surface by the winch 32.

The burst head 14 is attached to the front end 16 of the housing 12 via a taper lock. The taper lock is formed by engagement of the tapered front end 16 of the housing 12 with a complementary tapered bore (not shown) formed in the burst head 14. Forward movement of the tool 10 tightly engages the tapered front end 16 with the tapered bore. In contrast, rearward movement of the tool 10 disengages the front end 16 from the tapered bore. Thus, when the tool 10 reaches the end of the existing pipe 22, the tool 10 is switched into a reverse until the tool 10 is detached from the burst head 14. In reverse, the tool 10 is configured to move percussively in a rearward direction.

Figure 3:
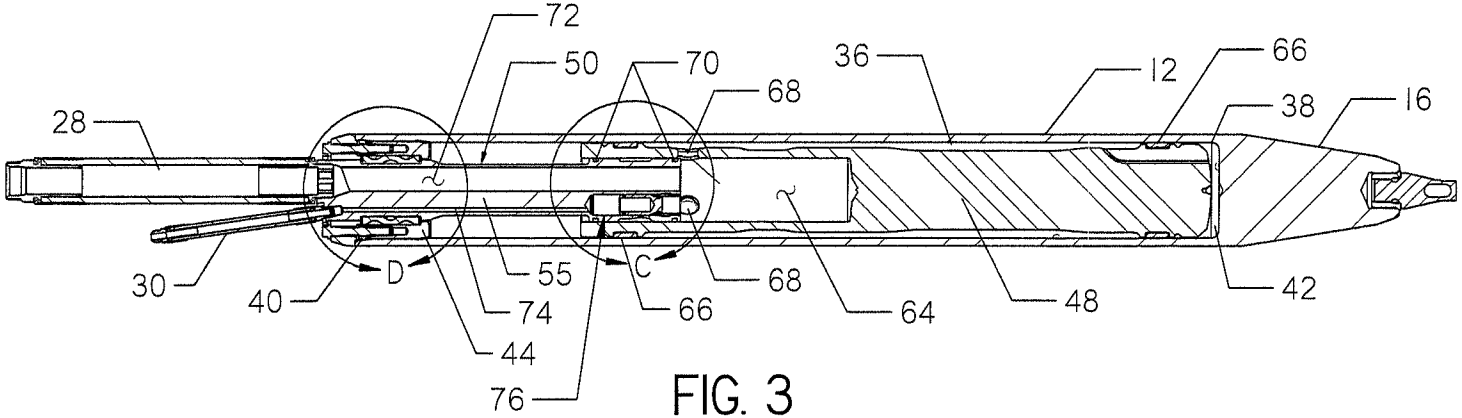
FIG. 3 is a cross-sectional view of the ramming tool, taken along line A-A from FIG. 2.

Turning to FIG. 3, the housing 12 has an elongate internal chamber 36 having opposed first and second ends 38, 40. The first end 38 of the chamber 36 is bounded by a first fixed anvil 42 situated within the front end 16 of the housing 12. The second end 40 of the chamber 36 opens on the rear end 20 of the housing 12. A fixed second anvil 44 is disposed within the chamber 36 immediately adjacent the second end 40 of the chamber 36.

Figure 5:
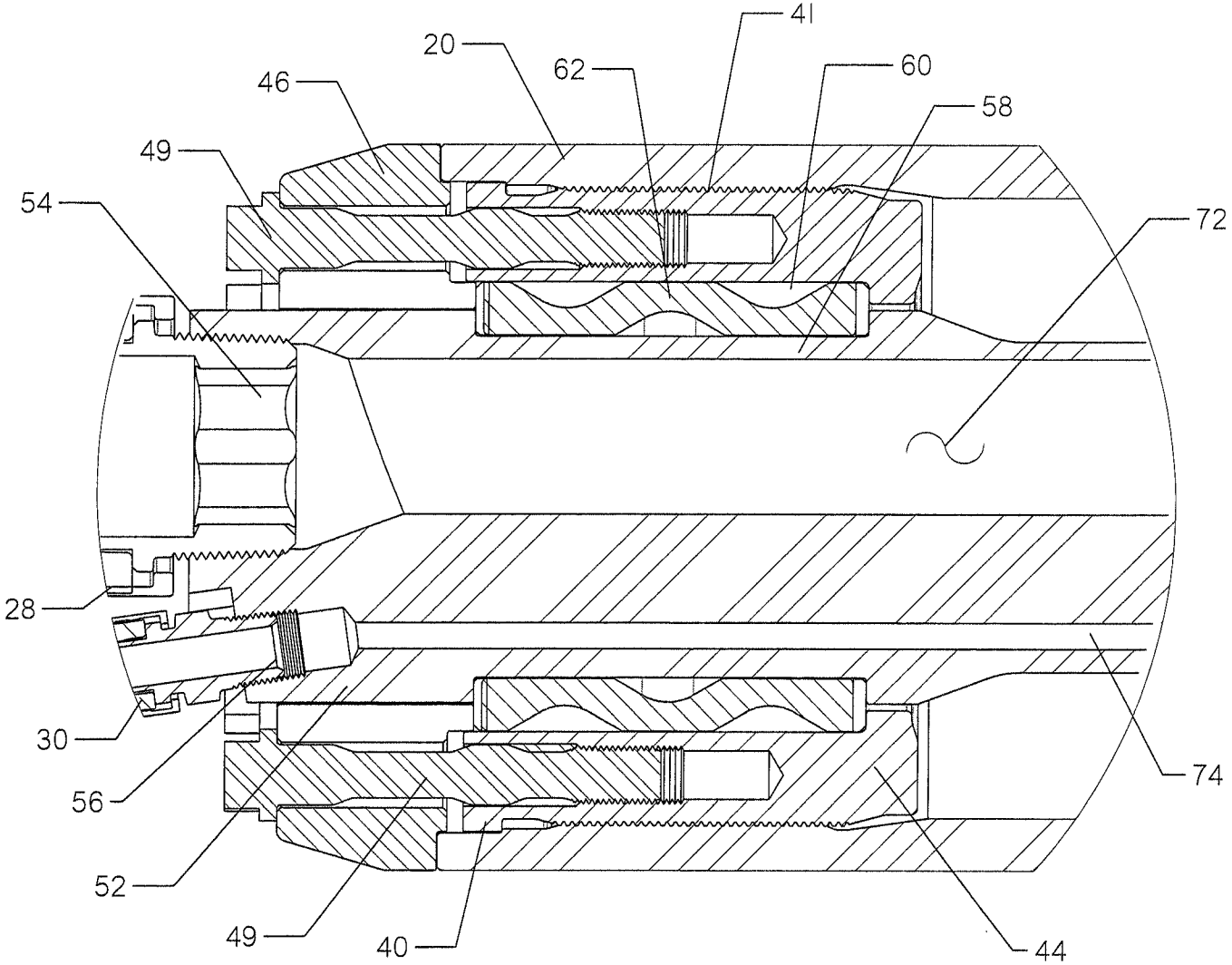
FIG. 5 is an enlarged view of area D shown in FIG. 3.

With reference to FIGS. 3 and 5, the second anvil 44 is attached to the internal walls of the housing 12 by mating threads 41. A tail cap 46 positioned above the second anvil 44 closes the opening formed at the rear end 20 of the housing 12. The tail cap 46 is secured in place by a plurality of bolts 49 interconnecting the tail cap 46 and second anvil 44. In alternative embodiments, the tail cap 46 may thread onto the rear end 20 of the housing 12.

A reciprocating striker 48 is positioned within the chamber 36 between the first and second anvil 42, 44. Movement of fluid within the chamber 36 powers movement of the striker 48. A compressed fluid, such as air, is distributed throughout chamber 36 via a fluid distribution block 50 positioned at least partially within the chamber 36.

Figure 4:
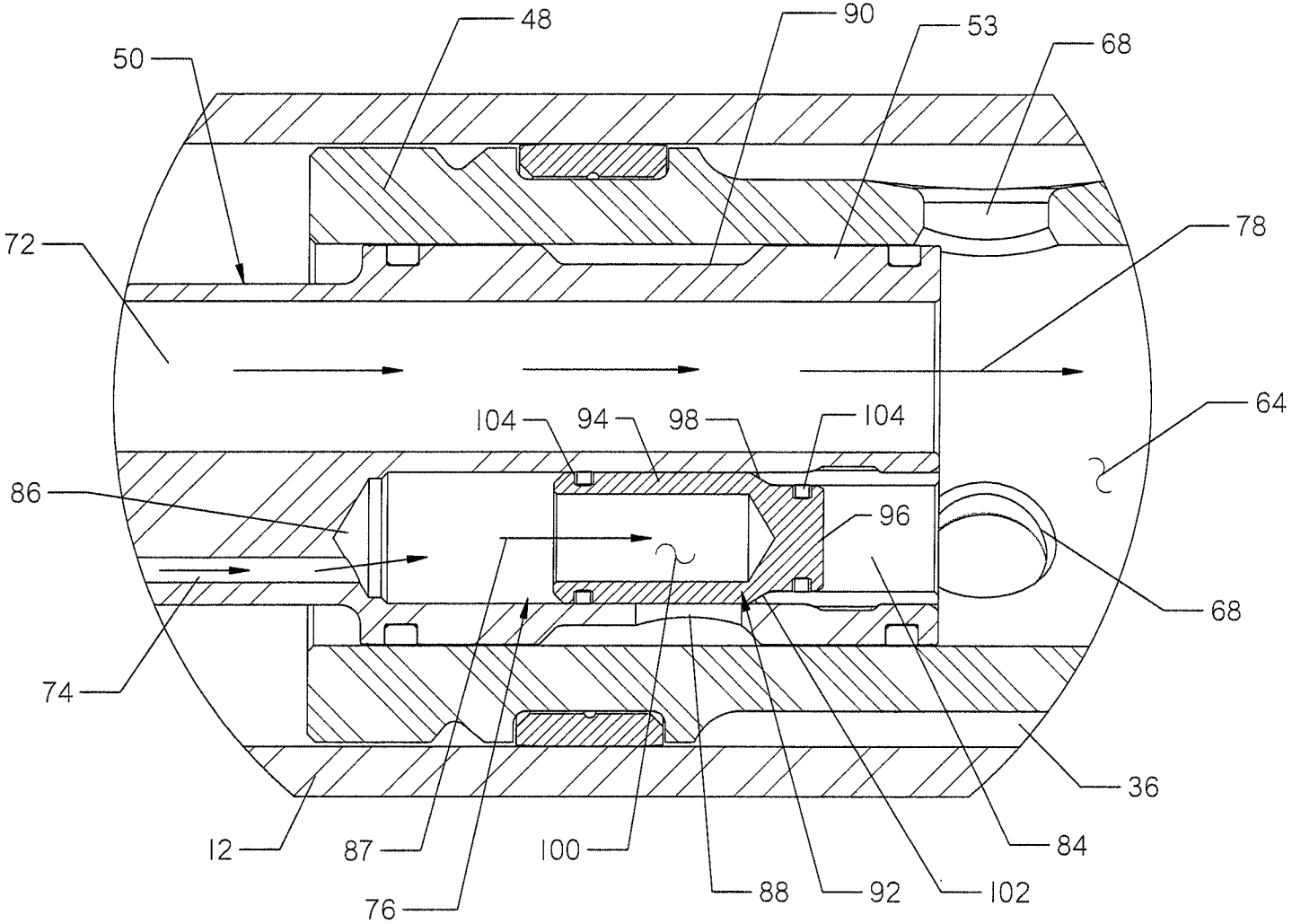
FIG. 4 is an enlarged view of area C shown in FIG. 3.

The block 50 has a rear end 52 joined to a front end 53, shown in FIG. 4, by an elongate body 55. The rear and front ends 52, 53 have maximum cross-sectional dimensions greater than that of the elongate body 55. The rear end 52 is positioned adjacent the second end 40 of the chamber 36. The front end 53 is positioned within the chamber 36 about halfway between its first and second ends 38, 40.

Continuing with FIG. 5, the rear end 52 of the block 50 is disposed within aligned central openings formed in the second anvil 44 and the tail cap 46. Such positioning causes the second anvil 44 and tail cap 46 to surround the rear end 52 of the block 50. At least a portion of the rear end 52 of the block 50 projects from the edge of the tail cap 46. The projecting portion is configured as a first connection point 54 for the first hose 28. In alternative embodiments, the first connection point may be disposed within the tail cap 46. A second connection point 56 is formed in the block 50 for connecting to the second hose 30. The second connection point 56 is disposed within the tail cap 46 in FIG. 3. In alternative embodiments, the second connection point may project from the edge of the tail cap 46.

An endless groove 58 is formed in the outer surface of the rear end 52 of the block 50. The groove 58 is formed complementary to an endless groove 60 formed in the internal walls of the second anvil 44. An isolator 62 is positioned within the adjoining grooves 58, 60. The isolator 62 maintains the axial and concentric positioning of the block 50 within the internal chamber 36. The isolator 62 also provides shock absorption for the block 50 during operation.

With reference to FIGS. 3-4, a central bore 64 is formed within the striker 48 for closely receiving the front end 53 of the block 50. As shown in FIG. 3, the internal walls of the central bore 64 surround the front end 53 of the block 50. During operation, the striker 48 reciprocates back and forth over the block 50. One or more seals 66 may be positioned around the outer surface of the striker 48 to help maintain pressure during operation.

A series of timing ports 68 are formed in the walls of the striker 48 surrounding its central bore 64. Movement of the striker 48 over the front end 53 of the block 50 seals the timing ports 68 from fluid communication with the central bore 64. One or more seals 70 may be positioned around the outer surface of the front end 53 of the block 50 to help maintain pressure during operation.

Continuing with FIG. 3, a first rectilinear passage 72 and a second rectilinear passage 74 are formed in the fluid distribution block 50. The first passage 72 opens on both the rear and front end 52, 53 of the block 50. The second passage 74 opens on the rear end 52 of the block 50 and opens into a valve 76, which will be described later herein, formed in the front end 53 of the block 50. The first and second passages 72, 74 each open on the rear end 52 of the block 50 at connection points 54, 56.

Figure 9:
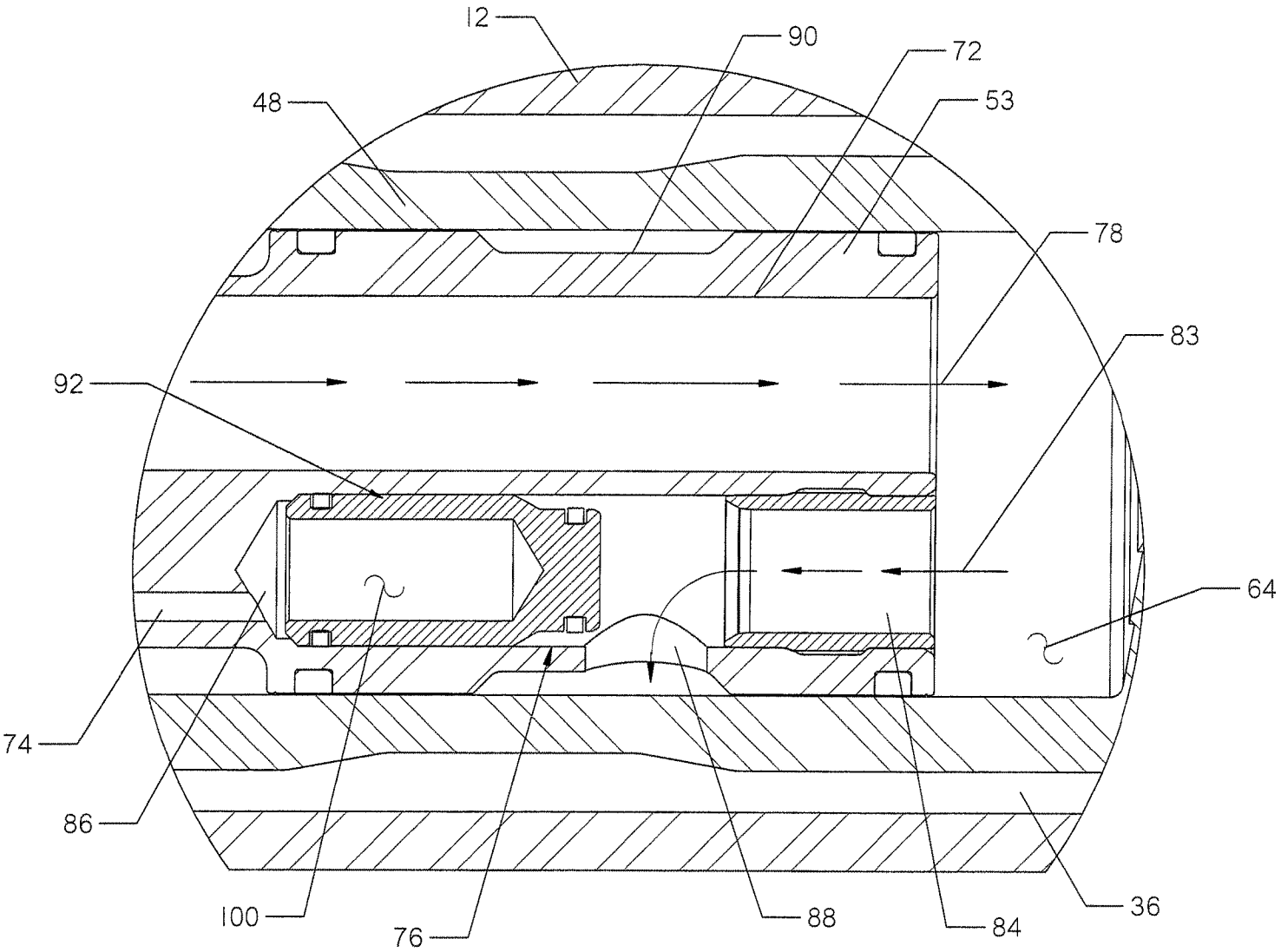
FIG. 9 is an enlarged view of area F shown in FIG. 8.

With reference to FIGS. 3-4, the tool 10 moves in a forward direction as a result of fluid flow along a forward fluid path, shown by arrows 78 in FIGS. 4 and 9. Along the forward fluid path, fluid travels from the first hose 28 into the first passage 72. From the first passage 72, the fluid flows into the central bore 64 formed in the striker 48. Entry of fluid into the central bore 64 forces the striker 48 forward until it strikes the first anvil 42.

As fluid flow into the central bore 64 continues, fluid pressure builds within the bore 64, which is sealed from the internal chamber 64. The central bore 64 remains sealed from the internal chamber 36 until the timing ports 68 are moved in front of the front end 53 of the block 50, as shown in FIG. 4. Upon exposure of the timing ports 68 in front of the block 50, fluid within the central bore 64 may flow through the timing ports 68 and into the chamber 36.

Entry of fluid into the chamber 36 causes pressure to increase outside of the striker 48 and decrease within the central bore 64. This pressure change causes the striker 48 to move rearwardly over the distribution block 50. Rearward movement of the striker 48 re-seals the timing ports 68 from fluid communication with the internal chamber 36.

Figure 6:
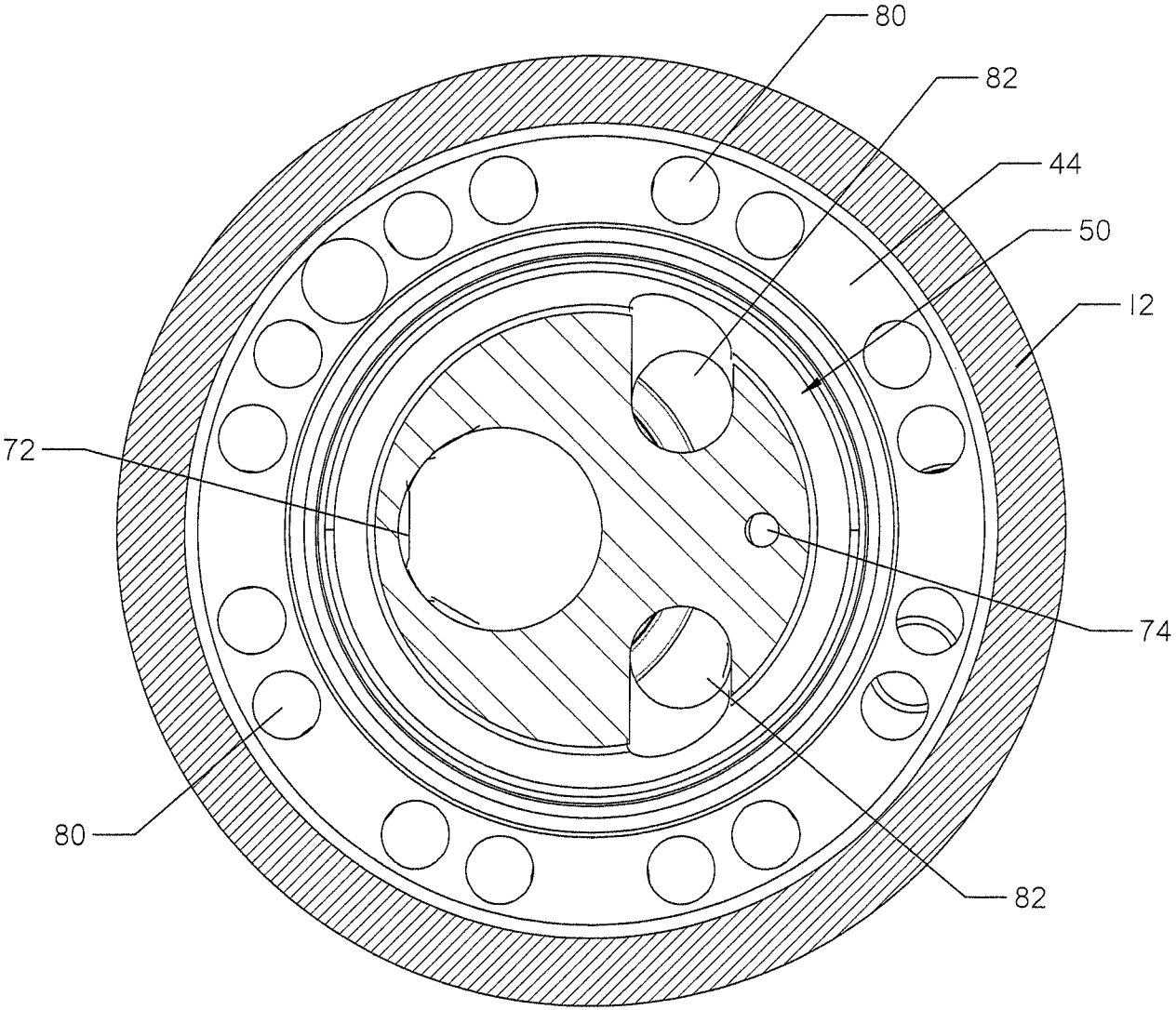
FIG. 6 is a cross-sectional view of the ramming tool, taken along line B-B from FIG. 2.

Contemporaneously, fluid within the internal chamber 36 may exhaust from the tool 10 through a plurality of primary exhaust passages 80 formed within the walls of the second anvil 44, as shown in FIG. 6. A set of secondary exhaust passages 82 are also formed within the fluid distribution block 50, as shown in FIG. 6. The secondary exhaust passages 82 provide an exit for excess fluid contained within the central bore 64 of the striker 48 as the striker 48 moves rearwardly over the block 50.

As fluid exhausts from the chamber 36, fluid is allowed to again fill the central bore 64 of the striker 48 and force the striker forward towards the first anvil 42. The constant feed of fluid through the forward fluid path causes the striker 48 to percussively strike the first anvil 42 and move the tool 10 in a forward direction.

In order to maintain the tool in its forward operating mode, the reverse fluid path, shown by arrows 83 in FIG. 9, must be sealed. Closure of the reverse fluid path is controlled by a valve 76, which is in turn controlled by fluid flow along the pilot fluid path, shown by arrows 87 in FIG. 4.

With reference to FIG. 4, the valve 76 is a shuttle valve having a first inlet port 84, a second inlet port 86, and an outlet port 88. The first inlet port 84 opens on the front end 53 of the block 50 and is in fluid communication with the first passage 72 and the central bore 64. The second inlet port 86 opens into the second passage 74. The outlet port 88 opens into an endless groove 90 formed in the outer surface of the front end 53 of the block 50. Fluid communication is possible between the outlet port 88 and a selected one of the first inlet port 84 and the second inlet port 86.

A shuttle 92 positioned within the valve 76 is configured to selectively isolate the outlet port 88 from fluid communication with the first inlet port 84. The shuttle 92 comprises a first portion 94 joined to a second portion 96 via a tapered portion 98. The first portion 94 has a maximum cross-sectional dimension greater than that of the second portion 96. A central bore 100 is formed within the shuttle 92 that opens on the end of the first portion 94. The end of the second portion 96 is closed. The tapered portion 98 is configured to tightly engage with a tapered seat 102 formed in the walls of the first inlet port 84. One or more seals 104 may be positioned around the outer surface of the shuttle 92 to maintain pressure during operation. In alternative embodiments, the shuttle 92 may have different shapes, such as that of a cone or ball.

With reference to FIGS. 3-4, fluid within the pilot fluid path travels from the second hose 30 into the second passage 74. From the second passage 74, the fluid travels into the valve 76 through the second inlet port 86. Fluid in the valve 76 enters the central bore 100 formed in the shuttle 92 and forces the shuttle 92 to move forward towards the first inlet port 84.

As the shuttle 92 moves forward, the tapered portion 98 of the shuttle 92 engages with the tapered seat 102. Such engagement closes the outlet port 88 and prevents fluid from passing between the first inlet port 84 and the outlet port 88. When the outlet port 88 is closed, there is no fluid flow along the reverse fluid path.

Figure 8:
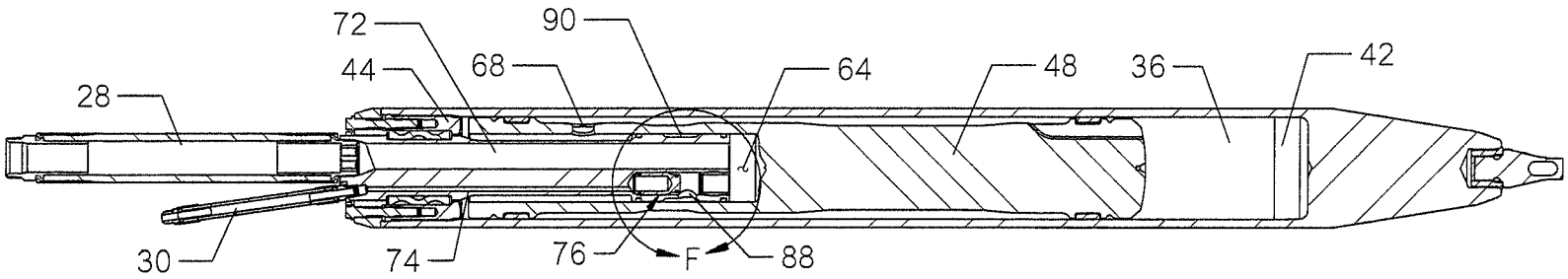
FIG. 8 is a cross-sectional view of the ramming tool, taken along line E-E from FIG. 7.

FIGS. 7-9 show operation of the tool 10 in its reverse mode. In order to switch the tool 10 into reverse, the flow of fluid through the pilot fluid path is stopped, vented to the atmosphere, or significantly decreased. Decreasing or stopping the flow of fluid through the pilot fluid path decreases pressure contained within the central bore 100 of the shuttle 92. This decrease in pressure allows fluid entering the first inlet port 84 of the valve 76 to force the shuttle 92 rearward towards the second inlet port 86, as shown in FIG. 9.

Movement of the shuttle 92 towards the second inlet port 86 exposes the outlet port 88 to the first inlet port 84. After the outlet port 88 is opened, fluid communication is established between the forward fluid path and the reverse fluid path 83, shown in FIG. 9. Fluid entering the tool 10 by way of the forward fluid path is routed onto the reverse fluid path 83. The forward and reverse fluid paths are neither wholly or partially coextensive. Fluid in the reverse fluid path is in fluid communication with fluid in the forward fluid path.

Movement of fluid through the reverse fluid path causes the tool 10 to operate in reverse. Fluid in the reverse fluid path travels from the first passage 72, into the central bore 64 of the striker 48. Fluid in the central bore 64 is permitted to flow into the valve 76 through the first inlet port 84. Once in the valve 76, the fluid flows through the outlet port 88 and into the groove go.

As fluid fills the groove go, fluid also fills the central bore 64 of the striker 48. Fluid pressure is allowed to build within the central bore 64 because it is sealed from the internal chamber 36. The central bore 64 remains sealed from the internal chamber 36 until the timing ports 68 are moved in-line with the groove 90. Upon exposure of the timing ports 68 to the groove 90, fluid within groove go may flow through the timing ports 68 and into the internal chamber 36.

Entry of fluid into the chamber 36 causes pressure to increase outside of the striker 48 and decrease within the striker. This pressure change causes the striker 48 to move rearwardly over the distribution block 50 until the striker 48 impacts the second anvil 44. Contemporaneously, fluid within the internal chamber 36 may exhaust from the tool 10 through the primary exhaust passages 80 formed within the walls of the second anvil 44 shown in FIG. 6. As the striker 48 moves rearwardly over the block 50, excess fluid contained within the central bore 64 is exhausted. Such exhaust fluid flows through the secondary exhaust passages 82 shown in FIG. 6.

As fluid exhausts from the chamber 36, fluid is allowed to again fill the central bore 64 of the striker 48 and force the striker forward towards the first anvil 42. Once the timing ports 68 are exposed to the groove go, the striker 48 is again forced to move rearwardly towards the second anvil 44. The constant feed of fluid through the reverse fluid path causes the striker 48 to percussively strike the second anvil 44 and move the tool 10 in a rearward direction.

Fluid within the central bore 64 is exhausted more quickly from the central bore 64 when the outlet port 88 is open, as compared to when it is closed. As a result, less fluid fills the central bore 64 when the outlet port 88 is open. The reduced fluid level results in a reduced pressure in the central bore 64, as compared to the chamber 36. This pressure imbalance causes rearward motion of the striker 48.

In reversible ramming tools known in the art, the forward and reverse flow paths are not selectively placed in fluid communication with one another. Rather, the paths are completely isolated from one another. The paths are also not powered by a single hose. Rather, the forward fluid path is powered by a single large hose and the reverse fluid path is powered by a single large hose. The hoses may each have a minimum diameter of around 1.25 inches. This construction requires two large hoses to stretch the entire length of the new pipe 18, shown in FIG. 1.

In contrast, the tool 10 utilizes a single first hose 28 to power both the forward and reverse fluid paths. The tool 10 uses a much smaller second hose 30 to operate the valve 76 in order to switch the fluid between the forward and reverse paths. The first hose 28 typically has a minimum diameter of around 1.25 inches, while the second hose 30 may have a minimum diameter of 0.5 inches. Thus, the burden and labor associated with the hoses is significantly reduced. The minimum diameter of the second hose 30 may be small because the minimum diameter of the second passage 74 is less than half the size of the minimum diameter of the first passage 72, as shown in FIG. 6. The second passage 74 may have a minimum diameter of ⅜ inch or less.

Changes may be made in the construction, operation and arrangement of the various parts, elements, steps and procedures described herein without departing from the spirit and scope of the invention as described in the following claims.

The invention claimed is:

1. A ramming tool, comprising:
- a housing having an elongate internal chamber having opposed ends;
- a fixed first anvil situated within and supported by the housing at one end of the chamber; in which the first anvil is fixed relative to the housing;
- a fixed second anvil situated within and supported by the housing at the other end of the chamber; in which the second anvil is fixed relative to the housing:
- a reciprocating striker positioned within the chamber between the anvils;
- a fluid distribution block fixedly positioned within the chamber and comprising:
  - a forward fluid path;
  - a reverse fluid path fluidly communicable with the forward fluid path;
  - in which fluid flow through the communicating forward and reverse fluid paths causes the striker to impact the second anvil, and in which fluid flow through the forward fluid path, in isolation from the reverse fluid path, causes the striker to impact the first anvil; and
  - a shuttle valve supported by the fluid distribution block and having a first inlet port in fluid communication with the forward fluid path, a second inlet port. and an outlet port in fluid communication with the reverse fluid path; in which the shuttle valve is adapted to selectively isolate the forward and reverse fluid paths.

2. The ramming tool of claim 1 in which the forward and reverse fluid paths are neither wholly nor partially coextensive.

3. The ramming tool of claim 1 in which the fluid distribution block further comprises:
- a pilot fluid path in fluid communication with the valve.

4. The ramming tool of claim 3 in which the valve is a shuttle valve having a first inlet port in fluid communication with the forward fluid path, a second inlet port in fluid communication with the pilot fluid path, and an outlet port in fluid communication with the reverse fluid path.

5. The ramming tool of claim 4 in which the shuttle valve comprises a shuttle having an open first end and an opposed closed second end, in which the first end is in fluid communication with the pilot fluid path.

6. The ramming tool of claim 3 in which the forward, reverse and pilot fluid paths are neither wholly nor partially coextensive.

7. The ramming tool of claim 3 in which the pilot fluid path has a minimum diameter of ⅜ inch or less.

8. The ramming tool of claim 3 in which the pilot fluid path has a minimum diameter that is less than half of the minimum diameter of the forward fluid path.

9. The ramming tool of claim 3 in which the forward fluid path and the pilot fluid path each open on a rear end of the housing.

10. The ramming tool of claim 1 in which the striker has a central bore in fluid communication with the forward fluid path and the reverse fluid path.

11. The ramming tool of claim 10 in which at least one port is formed in a wall of the striker surrounding its central bore.

12. The ramming tool of claim 1 in which at least a portion of the striker surrounds at least a portion of the fluid distribution block.

13. The ramming tool of claim 1 in which the striker surrounds the valve.

14. The ramming tool of claim 1 in which the fixed second anvil surrounds at least a portion of the fluid distribution block.

15. The ramming tool of claim 1 in which an exhaust passage is formed in the fixed second anvil that opens on a rear end of the housing.

16. A ramming tool, comprising:

a housing having an elongate internal chamber having opposed ends;

a fixed first anvil situated within and supported by the housing at one end of the chamber;

a fixed second anvil situated within and supported by the housing at the other end of the chamber;

a reciprocating striker positioned within the chamber between the anvils; and a fluid distribution block fixedly positioned within the chamber and comprising:

a forward fluid path;

a reverse fluid path fluidly communicable with the forward fluid path;

in which fluid flow through the communicating forward and reverse fluid paths causes the striker to impact the second anvil, and in which fluid flow through the forward fluid path, in isolation from the reverse fluid path, causes the striker to impact the first anvil; and a valve supported by the fluid distribution block and adapted to selectively isolate the forward and reverse fluid paths;

in which the striker has a central bore in fluid communication with the forward fluid path and the reverse fluid path, and in which at least one port is formed in the wall of the striker surrounding the central bore.

17. A system, comprising:

a ramming tool, comprising:

a housing having an elongate internal chamber having opposed ends;

a fixed first anvil situated within and supported by the housing at one end of the chamber;

a fixed second anvil situated within and supported by the housing at the other end of the chamber;

a reciprocating striker positioned within the chamber between the anvils; and a fluid distribution block fixedly positioned within the chamber and comprising:

a forward fluid path;

a reverse fluid path fluidly communicable with the forward fluid path;

in which fluid flow through the communicating forward and reverse fluid paths causes the striker to impact the second anvil, and in which fluid flow through the forward fluid path, in isolation from the reverse fluid path, causes the striker to impact the first anvil;

a valve supported by the fluid distribution block and adapted to selectively isolate the forward and reverse fluid paths; and a pilot fluid path in fluid communication with the valve; and a first hose in fluid communication with the forward fluid path; and a second hose in fluid communication with the pilot fluid path.

18. The system of claim 17 in which the second hose has a minimum diameter of 0.5 inches or less.

19. The system of claim 17 further comprising:

a winch; and a cable haying a first end attached to the ramming tool and a second end attached to the winch.

20. The system of claim 17 in which the ramming tool is engaged with an underground pipe.

* * * * *